United States Patent [19]

Turner

[11] 4,049,544

[45] Sept. 20, 1977

[54] METHOD AND DEVICE FOR SEPARATING PARTICLES

[76] Inventor: Henry Neil Turner, 95-3rd St. NE., Graysville, Ala. 35073

[21] Appl. No.: 681,173

[22] Filed: Apr. 28, 1976

Related U.S. Application Data

[63] Continuation-in-part of Ser. No. 539,169, Jan. 7, 1975, abandoned.

[51] Int. Cl.[2] ..... B07B 13/00

[52] U.S. Cl. ..... 209/45; 209/81 R; 219/76

[58] Field of Search ..... 219/76; 209/1, 45, 46, 209/127 R, 127 F, 129, 81 R

[56] References Cited

U.S. PATENT DOCUMENTS

| | | | |
|---|---|---|---|
| 581,908 | 5/1897 | Gent et al. | 209/46 X |
| 1,116,951 | 11/1914 | Sutton et al. | 209/127 A |
| 2,548,771 | 4/1951 | Carpenter | 209/127 R |
| 3,097,160 | 7/1963 | Rich | 209/46 X |
| 3,477,568 | 11/1969 | Madrid | 209/127 R |
| 3,627,124 | 12/1971 | Hance et al. | 209/45 |
| 3,922,516 | 11/1975 | Valtchev et al. | 219/76 |

*Primary Examiner*—Frank W. Lutter
*Assistant Examiner*—Ralph J. Hill
*Attorney, Agent, or Firm*—Blair & Brown

[57] ABSTRACT

A method and a device to separate conductive particles from a mixture of conductive and non-conductive particles comprising a carbon element extending along and close to but out of contact with a metal drum the carbon element being connected to one terminal of an electric welding machine and the drum to the other terminal so that conductive particles will be welded to the drum to be later scraped off.

5 Claims, 4 Drawing Figures

METHOD AND DEVICE FOR SEPARATING PARTICLES

CROSS REFERENCE TO RELATED APPLICATIONS

This application is a continuation-in-part of my copending application Ser. No. 539,169, filed Jan. 7, 1975 entitled MATERIAL SEPARATOR, now abandoned.

BACKGROUND OF THE INVENTION

Field of the Invention

Summary of the Invention

In reducing automobiles or the like to usable scrap the automobile is reduced to small particles in a shredder. Ferrous materials are separable from the remaining particles by magnetic separation, and some light non-metallic material can be separated by air cleaning.

The non-ferrous metal particles and the heaviest non-metallic particles have, until the present invention, not been readily separable because the pieces of tires, rubber hose, etc. are as heavy, or heavier, than the non-ferrous metal particles so that the air cleaning has resulted in at best a mixture of 40% non-metallic to 60% metallic particles.

The machine of the present invention will produce a 95% non-ferrous metal product when used in connection with a shredder.

It is the principal object of the present invention to provide a means and method of separating non-ferrous metal particles from non-conductive particles.

Other objects and advantages will become apparent in the following specification, when considered in light of the attached drawings.

DESCRIPTION OF THE PREFERRED EMBODIMENT

Figure 1:
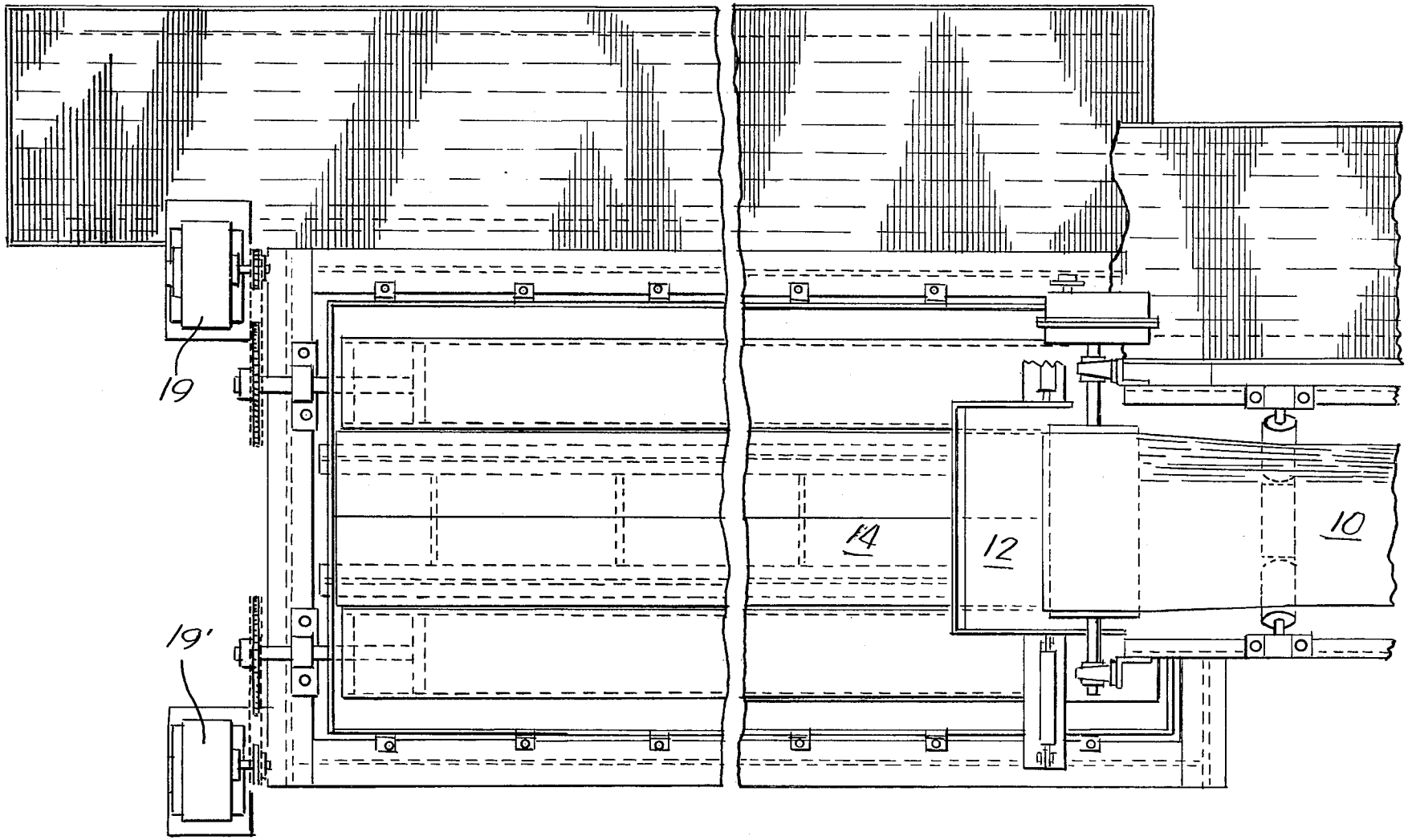
FIG. 1 is a plan view of the device partly cut away.
Figure 2:
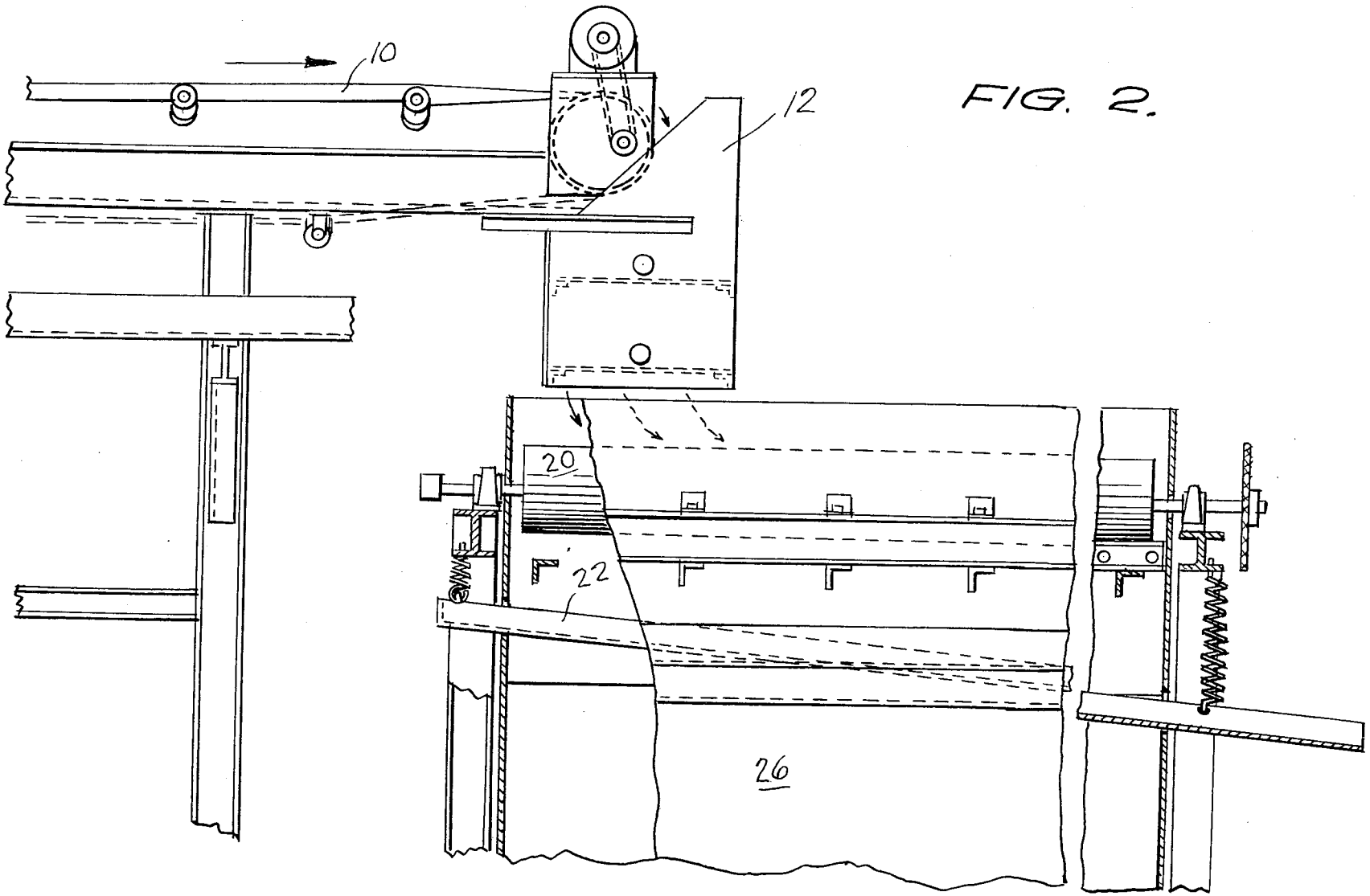
FIG. 2 is a side elevation partly broken away.

Referring to FIGS. 1 and 2 a belt conveyor 10 feeds the mixture of non-ferrous metal and non-conductive particles to a vibrating box 12 to feed the particles as uniformly as possible to the machine of the present invention.

Figure 3:
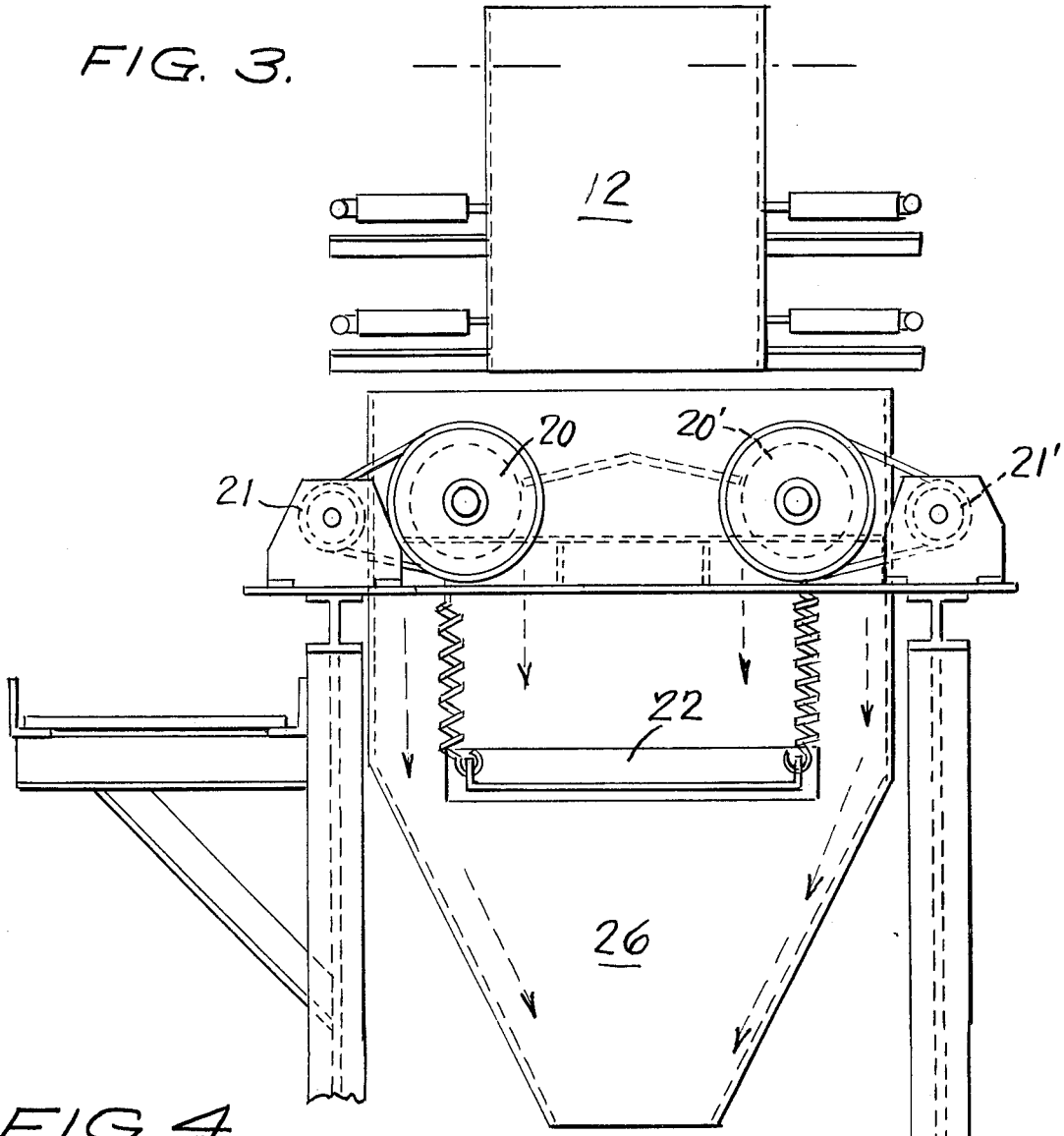
FIG. 3 is an end elevation of the device.
Figure 4:
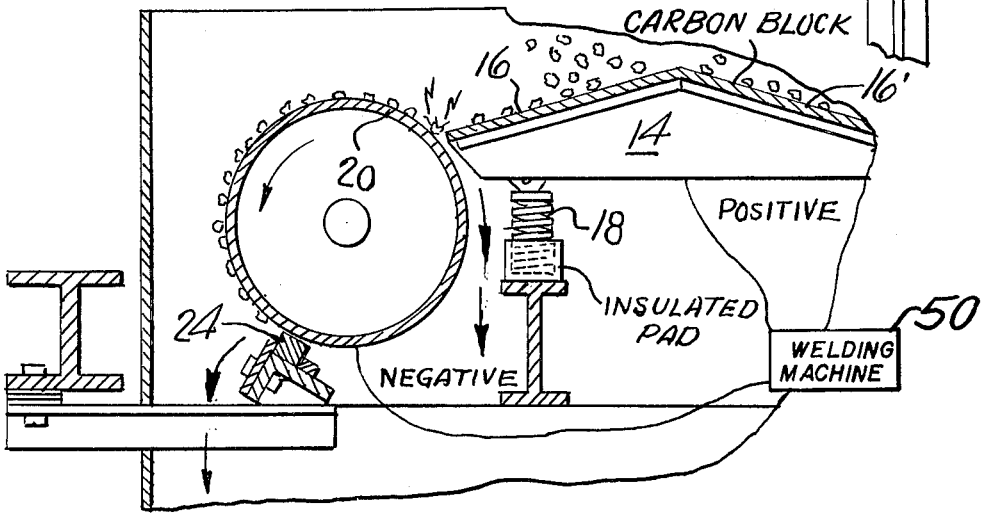
FIG. 4 is a fragmentary section taken on line 4—4 of FIGS. 1 and 2.

Referring now to FIGS. 3 and 4 as well as FIG. 1 it will be seen that the particles are discharged from the vibrating distributing element 12 onto one end of a vibrating conveying gently sloping table 14. The top surface of vibrating table 14 is shown as being high in the center and sloping to the sides to distribute the particles from element 12 along the table and feed them outwardly to bring the particles to the outer edges of the table. The surfaces 16, 16′ of the vibrating table 14 are of carbon, at least along the edges. The vibrating table 14 is mounted on springs 18 (see FIG. 4) which are electrically insulated. Table 14 is connected electrically to one terminal of an electric welding machine (not shown). Any known means may be used to vibrate table 14.

Mounted on the frame of the machine are two metallic drums 20, 20′. These drums may conveniently be made of steel pipe and are connected to the other terminal of the welding machine (not shown). Drums 20, 20′ are rotated in opposite directions so their surfaces move upwardly past carbon elements 16. Electric motors 21, 21′ drive the drums 20, 20′ at a moderate speed.

As noted above the edges of carbon elements 16, 16′ do not contact drums 20, 20′, so some small particles (fines) will fall through between the carbon and the drums and will be caught in a gravity chute 22 below table 14 and drums 20, 20′ and will be collected in any suitable way at the end of chute 22.

At the end of vibrating table 14 remote from vibrating box 12, the non metallic particles that are too large to pass between the carbons 16, 16′ and drums 20, 20′ will merely fall off the lower end of the vibrating table either into chute 22 or a separate chute may be provided if it is not desired to mix the fines, which will be principally non-metallic with the non-metallic material discharged from vibrating table 14.

At the underside, and in contact with each drum is a scraper 24 under drum 20 (scraper 24′ under drum 20′ not shown in FIG. 4).

The non-ferrous particles fed along vibrating table 14 will bridge the gap between carbons 16, 16′ and drums 20, 20′. Since the carbons and the drums are connected to the two terminals of a welding machine current will pass through the metal particle which will then adhere to the drums 20, or 20′ to be carried up over the top of the drum and down to scraper 24 or 24′ where the particle is scraped off of the drum. Having thus described the preferred embodiment of the invention it should be understood that numerous structural modifications and adaptations may be resorted to without departing from the spirit of the invention.

What is claimed is:

1. A method of separating a mixture of conductive particles and non-conductive particles including the steps of feeding said mixture onto an inclined carbon block, vibrating the block providing the block with an electrical potential of one polarity sufficient to weld, feeding these particles over a drum, rotating the drum, providing the drum with an opposite electrical potential, and scraping the conductive particles off of the drum at a point remote from the area of particle feeding.

2. An apparatus for separating a mixture of conductive particles and non-conductive particles comprising;

welding means for charging said conductive particles, means for depositing said mixture onto a rotating drum at any area on said drum where the particles will fall off said drum, said means for depositing and said rotating drum being connected to said welding means at opposite polarities whereby said conductive particles will be welded to and carried on said drum to a point remote from said non-conductive particles and means at said point to remove said conductive particles.

3. The apparatus of claim 2 in which said means for depositing said mixture onto a rotating drum comprises a charged carbon block.

4. The apparatus of claim 3 in which said means for depositing said mixture onto a rotating drum further comprises means for inclining and vibrating said charged carbon block.

5. The apparatus of claim 4 in which said means to remove said charged particles comprises a mechanical scraper.

* * * * *